US007186158B1

(12) United States Patent
Barber et al.

(10) Patent No.: US 7,186,158 B1
(45) Date of Patent: Mar. 6, 2007

(54) LIFE SAVING NECKLACE

(76) Inventors: Gerald L. Barber, 410 Hudson Rd., Greenville, SC (US) 29615; Dustan A. Barber, 1867 S. Hwy. 14, Greer, SC (US) 29650

( * ) Notice: Subject to any disclaimer, the term of this patent is extended or adjusted under 35 U.S.C. 154(b) by 0 days.

(21) Appl. No.: 11/295,855

(22) Filed: Dec. 7, 2005

(51) Int. Cl.
*B63C 9/08* (2006.01)

(52) U.S. Cl. ..... 441/123

(58) Field of Classification Search ..... 441/123
See application file for complete search history.

(56) References Cited

U.S. PATENT DOCUMENTS

| | | | |
|---|---|---|---|
| 1,385,581 | A | 7/1921 | Pallady |
| 1,806,786 | A | 5/1931 | Claus |
| 2,309,256 | A | 1/1943 | Rekersdres |
| 2,742,654 | A | 4/1956 | Hurt |
| 3,048,860 | A | 8/1962 | Richardson |
| 3,308,494 | A | 3/1967 | Licher |
| 3,633,230 | A | 1/1972 | Horton |
| 3,750,205 | A | 8/1973 | Pfeifer |
| 4,622,018 | A | 11/1986 | Blanc |
| 4,925,419 | A | 5/1990 | Susanna |
| 5,421,760 | A | 6/1995 | Blaga |
| 5,692,933 | A | 12/1997 | Bradley et al. |
| 5,845,937 | A | 12/1998 | Smith |
| 5,921,835 | A | 7/1999 | Gordon et al. |
| 6,270,386 | B1 | 8/2001 | Visocekas |
| 6,561,863 | B1 | 5/2003 | Campbell |
| 6,592,098 | B2 | 7/2003 | Kao et al. |
| 6,659,824 | B1 | 12/2003 | McCormick |
| 6,729,599 | B2 | 5/2004 | Johnson |
| 6,966,336 | B1 | 11/2005 | Renzi |
| 2003/0070716 | A1 | 4/2003 | Glousouf et al. |
| 2004/0029466 | A1 | 2/2004 | Kloessing |
| 2004/0127118 | A1 | 7/2004 | Simmons |
| 2004/0256585 | A1 | 12/2004 | Nielsen et al. |

FOREIGN PATENT DOCUMENTS

| | | | |
|---|---|---|---|
| JP | 02241890 | A * | 9/1990 |

* cited by examiner

*Primary Examiner*—Jesús D. Sotelo
(74) *Attorney, Agent, or Firm*—J. Bennett Mullinax, LLC

(57) ABSTRACT

An inflatable necklace designed to be worn around the neck of a young child is provided. The necklace contains a sensor which, in response to a pre-determined period of immersion and/or a sudden increase in pressure, will activate a gas source which inflates one or more bladders which expand outwardly from the necklace. The inflated bladders provide sufficient buoyancy and floatation to keep a child afloat until the child can be rescued.

9 Claims, 7 Drawing Sheets

LIFE SAVING NECKLACE

FIELD OF THE INVENTION

This invention is directed to a life preserver type device which is designed to be worn around the neck of the person, particularly young children. The life preserver device is initially in the form of a small necklace which, when subjected to immersion, will automatically deploy an inflated bladder which provides for flotation of the individual.

BACKGROUND OF THE INVENTION

There are a variety of self-inflatable life preservers known in the art. For instance, in U.S. Pat. No. 5,421,760 to Blaga, a self-inflatable collar life preserver is provided. The collar has a rigid frame which is used to retain compressed air within the unit. As such, the frame has a size, thickness, and rigidity provided by solid materials which most individuals would find uncomfortable and unsightly for prolonged use.

It is also known in the art to provide self-inflating life preservers such as the life preserver seen in the Cloessing published patent application US 2004/0029466 A1 in which a vest type preserver is provided having the ability to automatically inflate when immersed. While a vest type life preserver is beneficial, a vest type garment is often uncomfortable and is not designed to be worn for long periods of time by children or when the wearer is active at play or sports.

Accordingly, there remains room for improvement and variation within the art with respect to providing a self-inflating life preserver type device which can be worn for long periods of time having a construction suitable for use with small children.

SUMMARY OF THE INVENTION

It is one aspect of at least one of the present embodiments to provide for a self-inflating bladder which in an uninflated state lends itself to being worn around a child's neck as a necklace type device.

It is a further aspect of at least one of the present embodiments to provide for a life preserver device to be worn around an individual's neck which has a triggering mechanism which will inflate the device when immersed in water. The triggering device is resistant to deployment unless immersed and therefore can be worn during a shower or bath, during a rainstorm, when splashing in a wading pool, or other types of similar activity.

It is yet a further aspect of at least one of the present embodiments to provide for a self-inflatable life preserver device to be worn around the user's neck having a compact design and a lightweight construction.

It is a further aspect of at least one embodiment of the present invention to provide for a collar type life preserver device having a battery operated trigger which is responsive to immersion and which will activate a propellant or other evolved gas so as to inflate one or more air bladders associated with the collar.

It is a further aspect of at least one embodiment of the present invention to provide a propellant for a collar type life preserver in which a chemical reaction is used to generate an evolved gas, the evolved gas being used to inflate one or more air chambers associated with the life preserver collar.

It is a further aspect of at least one embodiment of the present invention to provide for an inflatable necklace having an electronic sensor having a time delay circuit which is responsive to immersion in water. Upon immersion for a pre-selected interval, the sensor will activate an inflation gas which may be in the form of a compressed gas or liquid within a sealed tube or trigger two or more reactants used to generate a rapid release of an inflation gas. The released gas is used to inflate a bladder provided from a fabric or web such as Mylar®, Kevlar®, or a coated fabric.

It is a further aspect of at least one embodiment of the present invention to provide for an inflatable life necklace having a diameter of one-half inch or less that can be snapped into place around a child's neck. The snap mechanism may include a child-resistant closure or lock which would prevent removal of the necklace by a small child.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
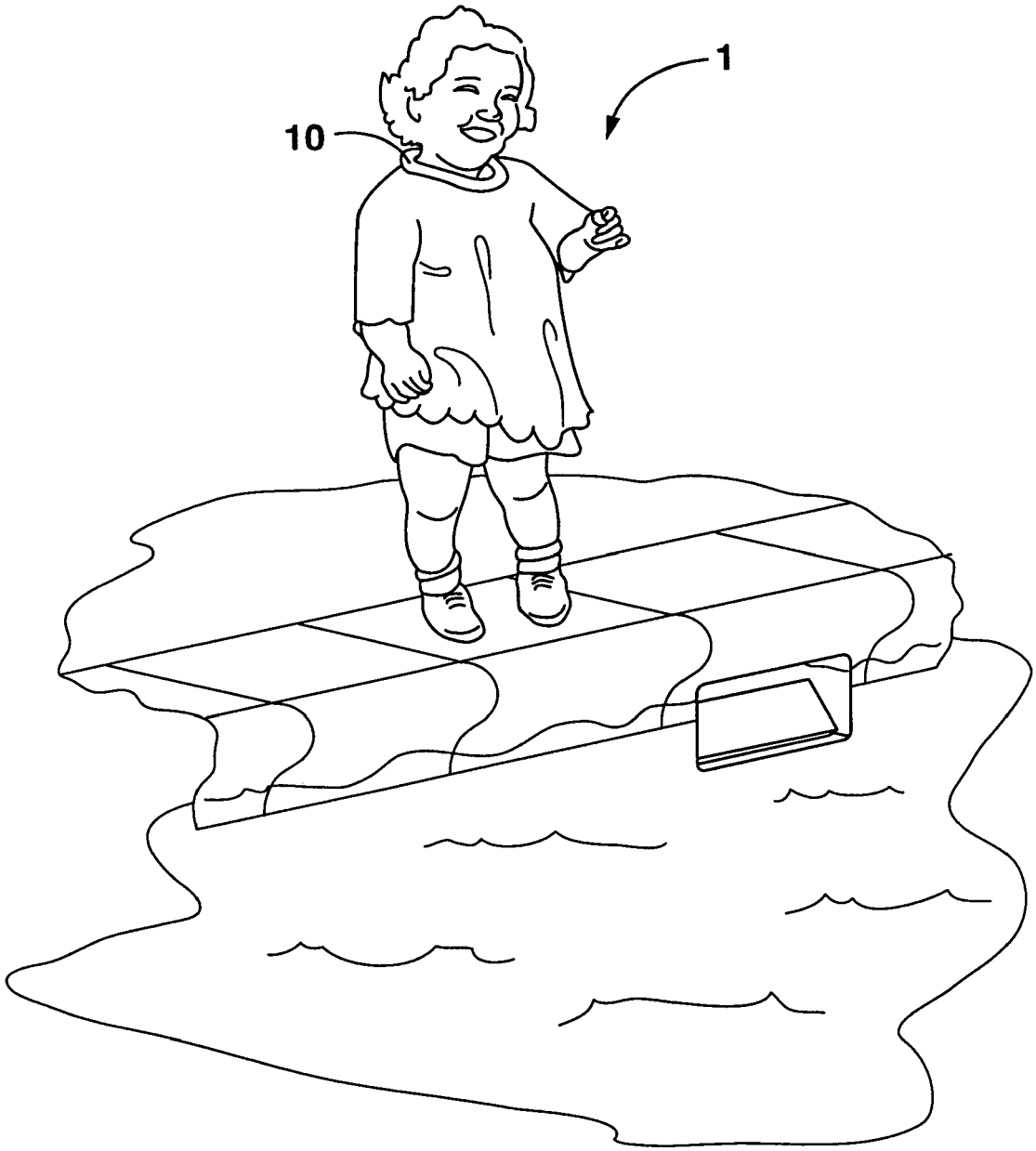
FIG. 1 is a perspective view of an inflatable life necklace being worn by a young child.
Figure 2:
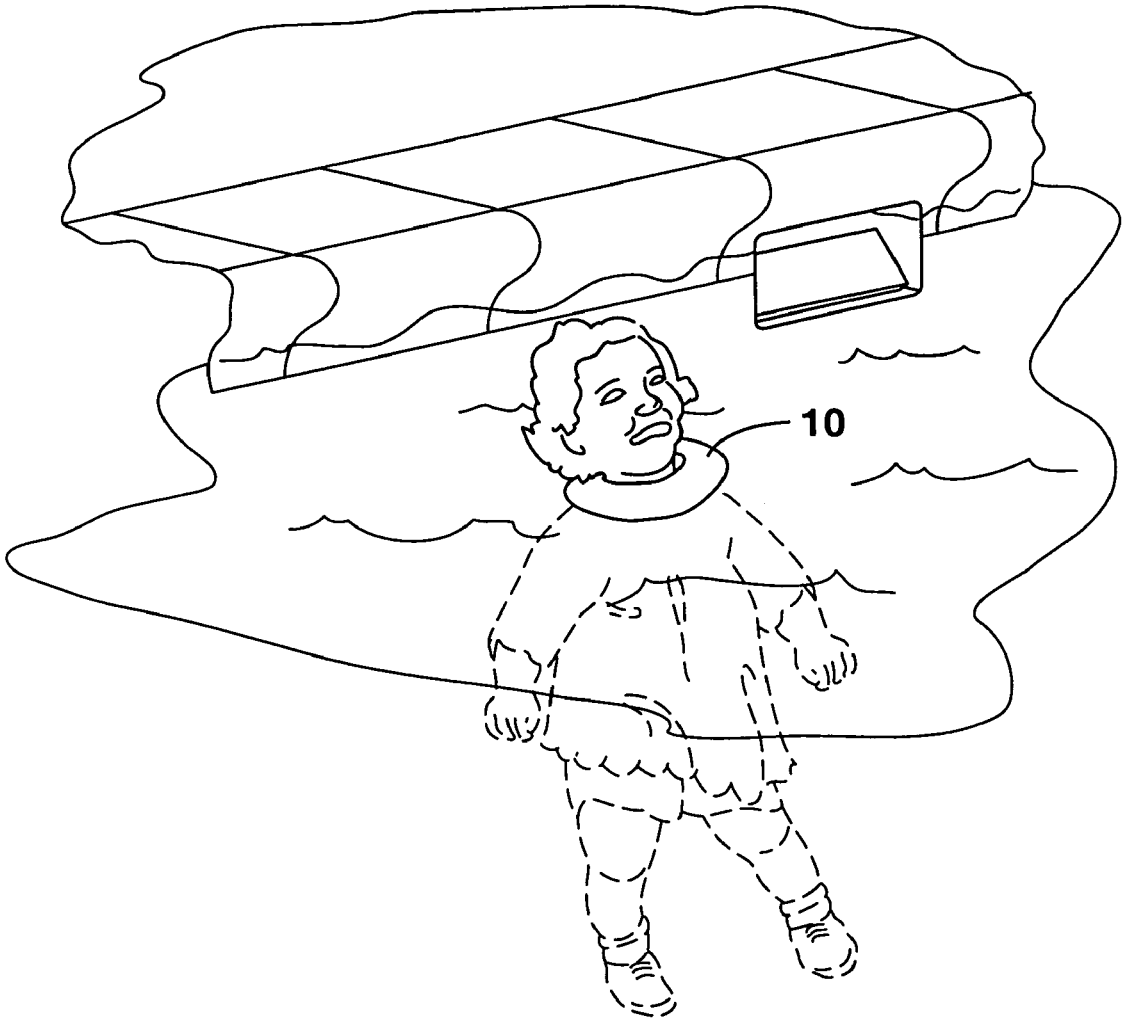
FIG. 2 illustrates the necklace seen in FIG. 1 following inflation.

As seen in reference to FIGS. 1 and 2, an inflatable necklace 10 is seen worn around the neck of a young child 1 in proximity to a swimming pool. As seen in FIG. 2, the necklace 10 is designed to automatically inflate when submerged in water.

Figure 3:
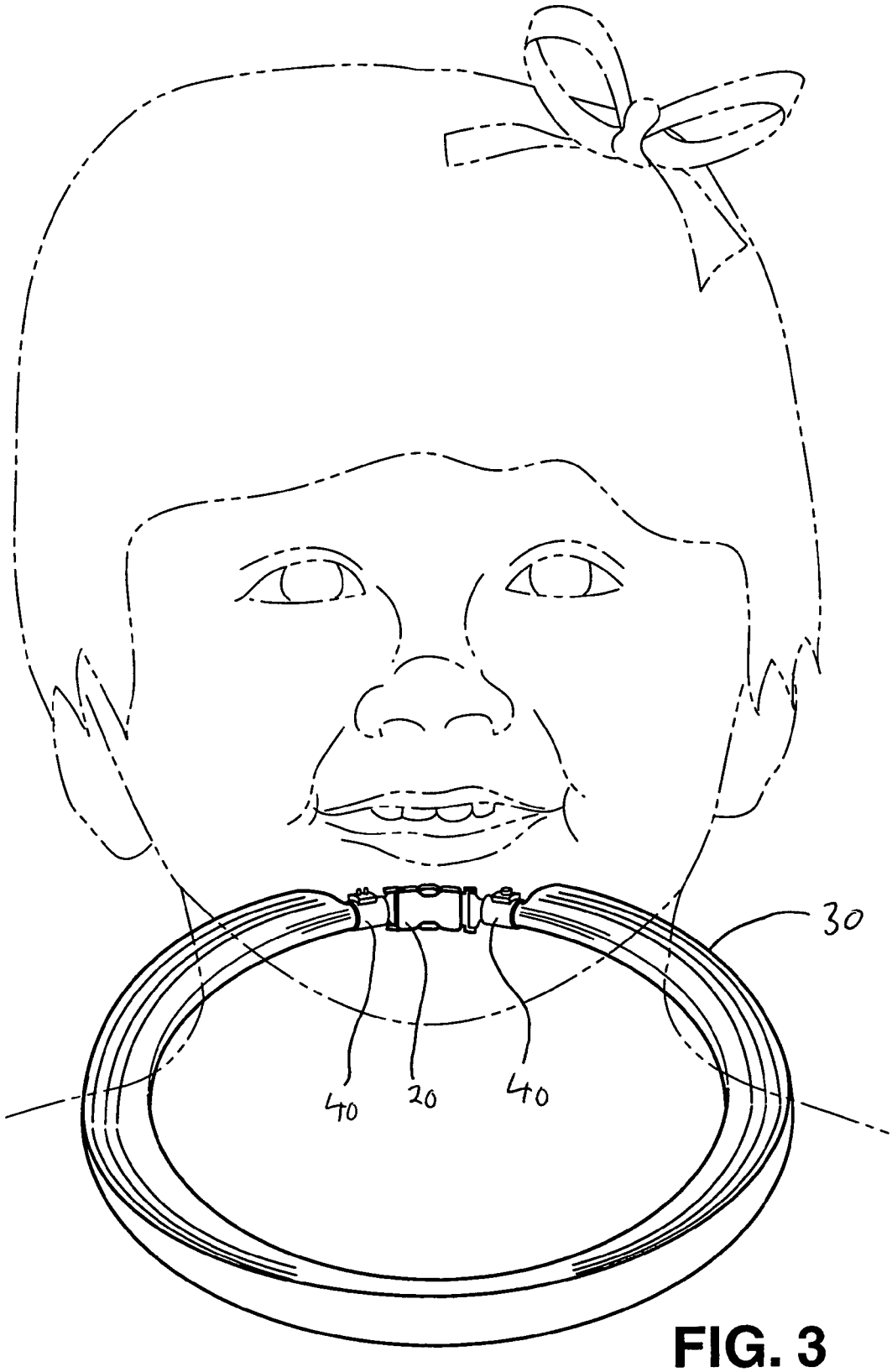
FIG. 3 is a perspective view of an embodiment of an inflatable necklace in an uninflated condition as seen in the environmental context of placement around a child's neck.
Figure 4A:
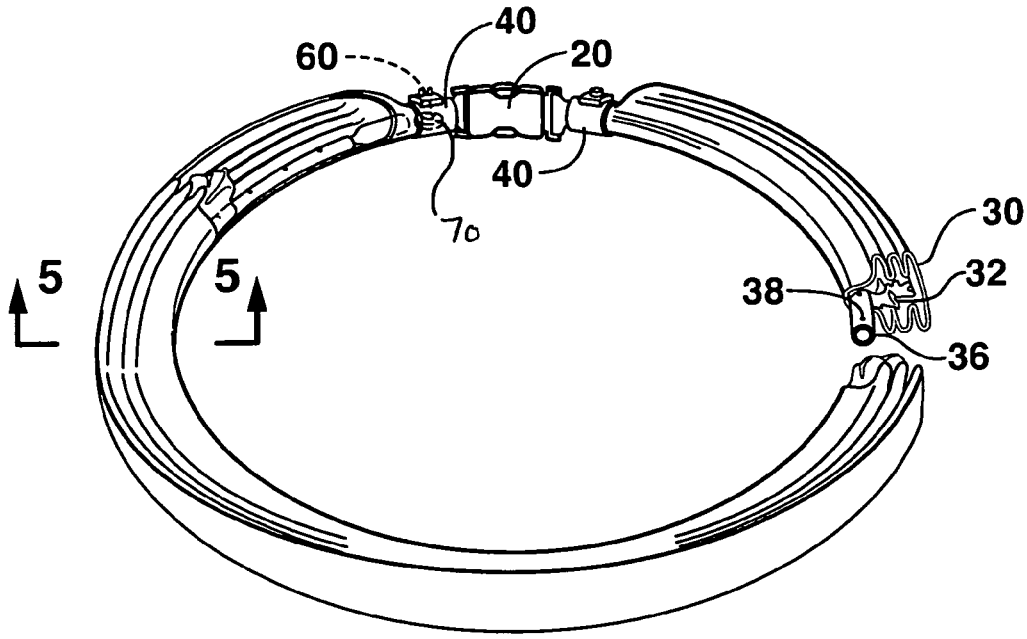
FIGS. 4A and 4B are perspective views in partial section showing the inflatable life necklace in a respective uninflated and inflated condition.
Figure 4B:
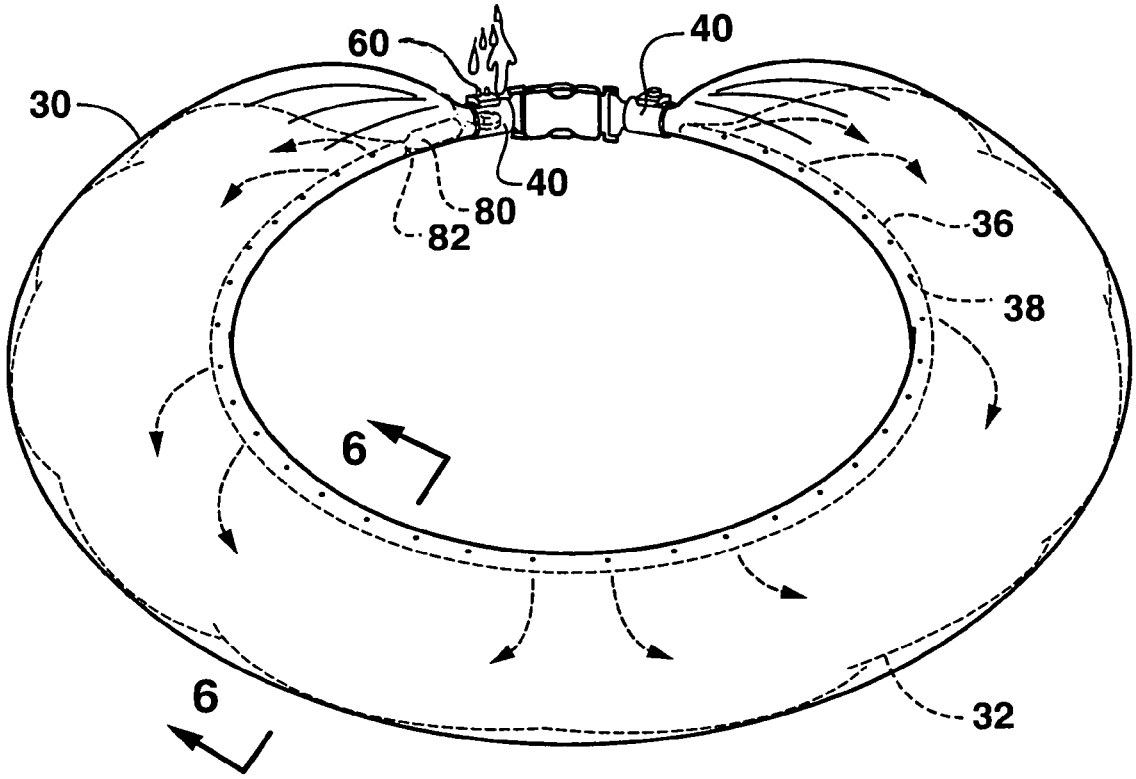

In reference to FIGS. 3 through 4B, the inflatable necklace 10 may be in the form of a refastenable necklace that can be worn around an individual's neck. Any number of conventional fasteners 20 may be used including clips, such as a 2-part nylon clip commonly used on bookbags, fanny packs, and similar articles. As indicated in FIGS. 3 through 4B, at least one portion of each inflatable necklace 10 comprises at least one inflatable bladder 30 which extends almost completely around the necklace 10. The at least one inflatable bladder 30 is part of an airtight bladder system defined by a seal between bladder 30 and an adjacent area of a housing 40 of necklace 10. The seal between the bladder 30 and housing 40 provides an airtight chamber within the interior of a bladder 30.

As seen in reference to FIGS. 3 through 4B, an optional inner bladder 32 may be provided which is housed within the interior of the bladder 30. A tube 36 extends from the respective housings 40 and extends substantially the entire circumferential distance of the necklace 10. Tube 36, which may be in the form of a flexible plastic, defines a plurality of apertures 38. When a compressed or evolved gas is released from a gas source 80, the gas is directed through an interior of the hollow tube 36 and passes through apertures 38 as seen by the directional arrows in FIG. 4B.

Figure 5:
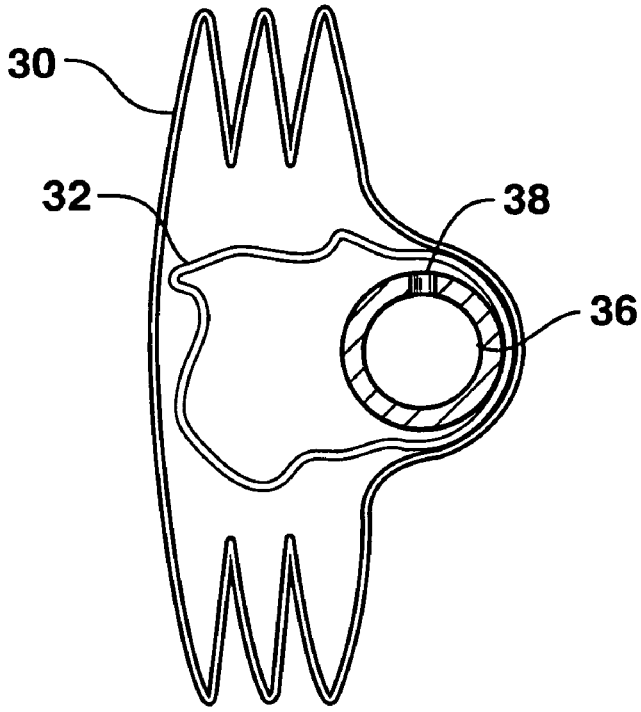
FIG. 5 is a cross section taken along line 5—5 as seen in FIG. 4A.
Figure 6:
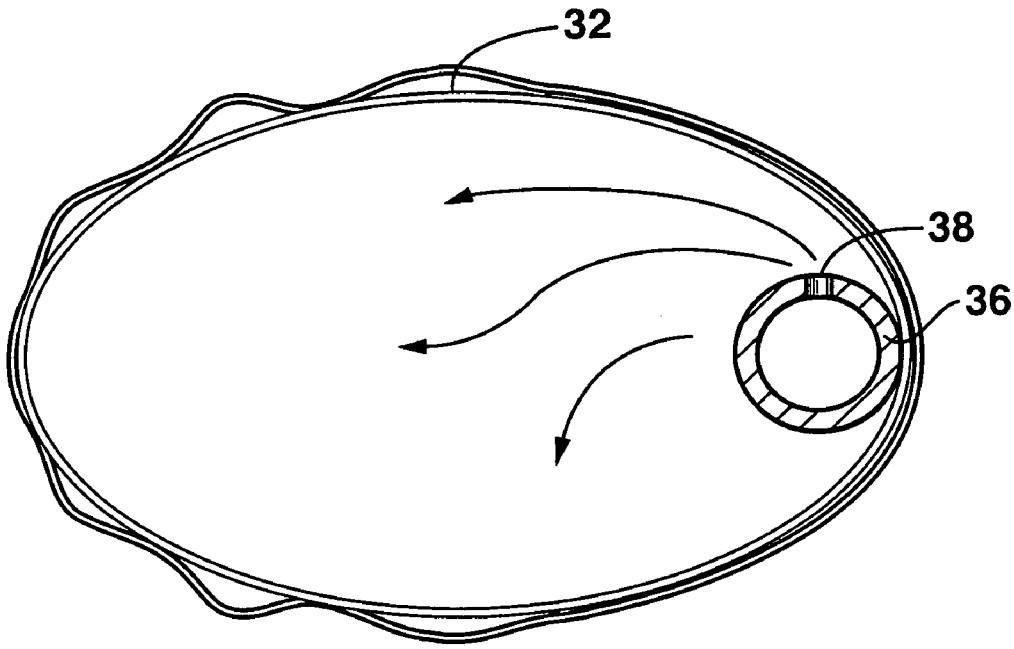
FIG. 6 is a cross section of the inflatable necklace taken along line 6—6 of FIG. 4B.

As best seen in reference to FIGS. 5 and 6, the released gas inflates optional inner bladder 32 (if present) and outer bladder 30 such that the necklace assumes an inflated condition. The volume of sealed air contained within bladder 30 and/or inner bladder 32 is sufficient to keep the child's head above water. When the optional bladder 32 is utilized, the outer bladder 30 may be provided of a fabric material which does not need to be airtight. The outer bladder layer 30 does need to be sufficiently flexible and resilient that a bladder 30 can expand or unfold in response to the inflation pressure exerted within the inner bladder 32.

The release of a compressed or evolved gas from gas source 80 is described in greater detail below. The operation of the gas source 80 is responsive to a sensor 60 as seen in FIGS. 4A and 4B. Sensor 60 is responsive to submersion under water and may have a variable time delay to avoid false activation from activities such as showers or bathing, rain, or water spray from aquatic activities. In addition, it is envisioned that sensor 60 may also be responsive to pressure changes such that a sudden increase in pressure, consistent with falling into a pool or pond, could cause the sensor 60 to activate prior to completion of a time interval requirement. Sensor 60 is powered by a battery 70 and which may be integral to sensor 60. Sensor 60 is in further electrical communication with a pressurized gas source 80 which may take several forms.

Figure 7A:
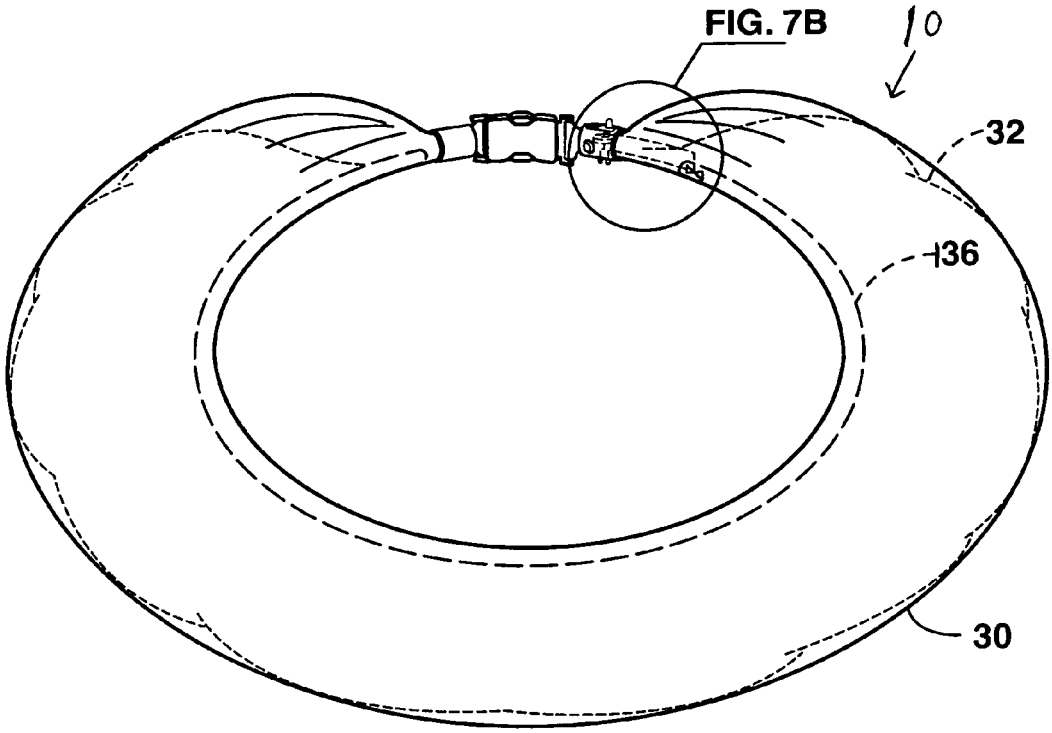
FIG. 7A is a perspective view in partial section of an inflated necklace showing one embodiment of the internal details of the inflation mechanism of the necklace.
Figure 7B:
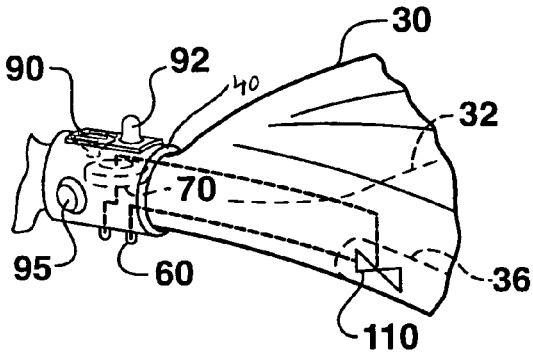
FIG. 7B is an enlargement of the indicated portion of FIG. 7A showing additional details of an embodiment of the inflatable necklace.

In an additional embodiment of the invention as seen in reference to FIGS. 7A and 7B, the pressurized gas may be contained within a sealed, hollow tube 136. As seen in reference to FIG. 7A, tube 136 extends nearly the entire length of the necklace 10. Tube 136 may be formed from either plastic or metal and suitable tubing is commonly used to hold pressurized fluids such as water or Freon® gas. As best seen in reference to FIG. 7B, an electronically controlled microvalve 110 may be placed in a sealed fashion within the tube 136. When sensor 60 is activated by immersion in water, a signal from sensor 60 will open microvalve 110 allowing the release of the pressurized content within tube 136 into the bladder 30 and/or 32. A number of suitable microvalves are commercially available and are widely used in medical device applications and in high pressure fluid control uses including satellites, spacecraft, and aircraft. Suitable microvalves may also be provided from the teachings of the following U.S. Pat. Nos. 6,966,336; 6,729,599; 6,592,098; and U.S. patent publications 20040256585 and 2003/0070716, the teachings and specifications of which are incorporated herein by reference.

There are a variety of sensors known in the art which can provide for the capabilities set forth herein for sensor 60. As used herein, the term "sensor" may be used to include the circuitry, the contacts, a suitable battery, and an appropriate housing to contain the various components which are used to provide an appropriate sensor. Set forth in FIG. 9 is a schematic of one electrical circuit that has been found useful with inflatable necklaces as described herein.

Figure 9:
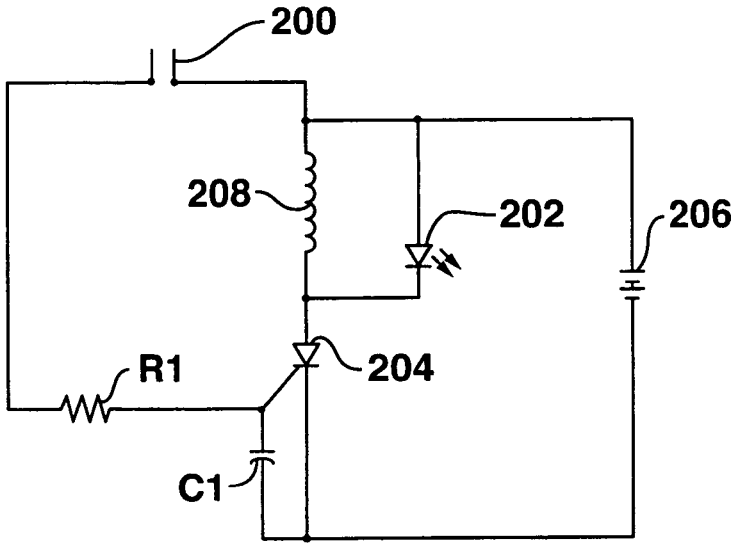
FIG. 9 is a schematic view of an electrical circuit of a sensor that may be used with the inflatable necklace.

The circuit set forth in FIG. 9 includes a battery 206, a resistor R1 (100 KΩ) and a capacitor C1 (100 μF). A pair of sensor contacts 200 are positioned approximately one-half inch apart. A spaced distance prevents the sensor from being prematurely activated by rain, splashing, or other aquatic activities which pose no risk of drowning. In the presently described circuitry embodiment, immersion of the contacts 200 for a 5 second interval will bring about a release and/or generation of an inflation gas as described herein. Further, battery 206 may be used to power an optional audible alarm, lights, or other signaling apparatus. As seen, the circuit incorporates diodes 202 and 204 and an inductor 208.

The inflatable bladder 30 or inner bladder 32 may be provided from a variety of suitable materials including nylon, polyethylene, and other textile materials coated with one or more layers of polyurethane, polyvinylchloride, or other coatings that provide a relatively gas impermeable bladder material. The bladders 30 or 32 may also be provided from an expandable material such as Lycra™, Lycra-Cordura™, latex, or Mylar®. The materials forming the portion of necklace 10 making up the inflatable bladder 30 and/or optional inner bladder 32 may be sonically welded or otherwise secured to the other portions of necklace 10, such as housing 40, thereby establishing an airtight seal between the inflatable bladder 30 and the adjacent portions of necklace 10.

To the extent a canister of a pressurized gas source 80 such as a pressurized tube 136 is used, such gas may be nitrogen, oxygen, air, $CO_2$, or mixtures thereof. It is also recognized that suitable gas sources may include a material which is in a liquid form when under pressure, but when released into the bladder 30 and/or 32 is in the form of a gas. Depending upon the size and extent of the opening of valve 110, the amount of pressure, and the size of the opening between the gas source and the interior of the inflation bladders 30 and/or 32, the inflation of the bladders may occur within a matter of seconds or other desired interval.

Figure 7C:
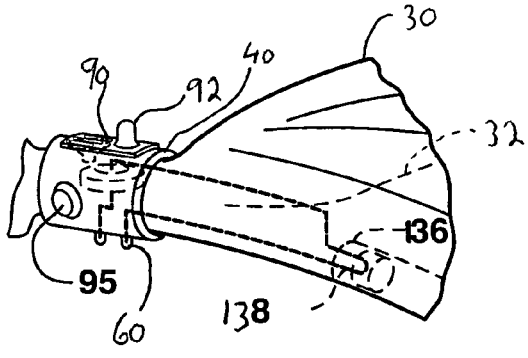
FIG. 7C is a view similar to FIG. 7B showing an alternative embodiment of an inflation mechanism of the inflatable necklace.

As seen in reference to FIG. 7C, a pressurized fluid is present inside tube 136. A sealed outlet 138 is defined along at least an end of the tube 136. When sensor 60 is activated, an electrical current may be used to heat wires embedded in a low temperature sealing material used to seal outlet 138. When sufficiently heated, the sealing material melts and allows the pressurized fluid to exit tube 136 and subsequently inflate bladder 30 and/or optional bladder 32.

In the alternative, a pressurized gas source 80 may be used using technology adapted for air bags and which may provide for a more rapid evolution of gas using reactants which will produce or release a gas of air, sodium oxide, or other suitable release gases. It is possible that the pressurized gas source in the form of a canister could actually be placed on the exterior of the inflatable necklace. While such a design is operative, it is believed preferable to have the gas source present within the interior of the necklace to discourage children from playing or tampering with the pressurized cartridge or other gas source 80.

It is also envisioned that the pressurized gas source could be provided by a chemical reaction in which two or more reactants are combined to generate the needed volume of gas. It is envisioned that sensor 60 may be used to trigger the release of one or more chemicals into an interior of the gas source vessel 80 which, in the presence of a second reactant chemical within vessel 80, results in the formation of a gas. The quantities of the reactants may be controlled so as to achieve a sufficient combination of pressure and volume of evolved gas.

Suitable reactants may include a mixture of a catalyst with hydrogen peroxide for the release of oxygen and/or hydrogen gas or a mixture of baking soda with an acidic solution such as acetic acid. In addition, the gas propellants used in airbag technology could be present in a reaction chamber such that when activated by sensor 60 the resulting chemical reaction generates the necessary volume of evolved gas to inflate the chamber(s).

Figure 8:
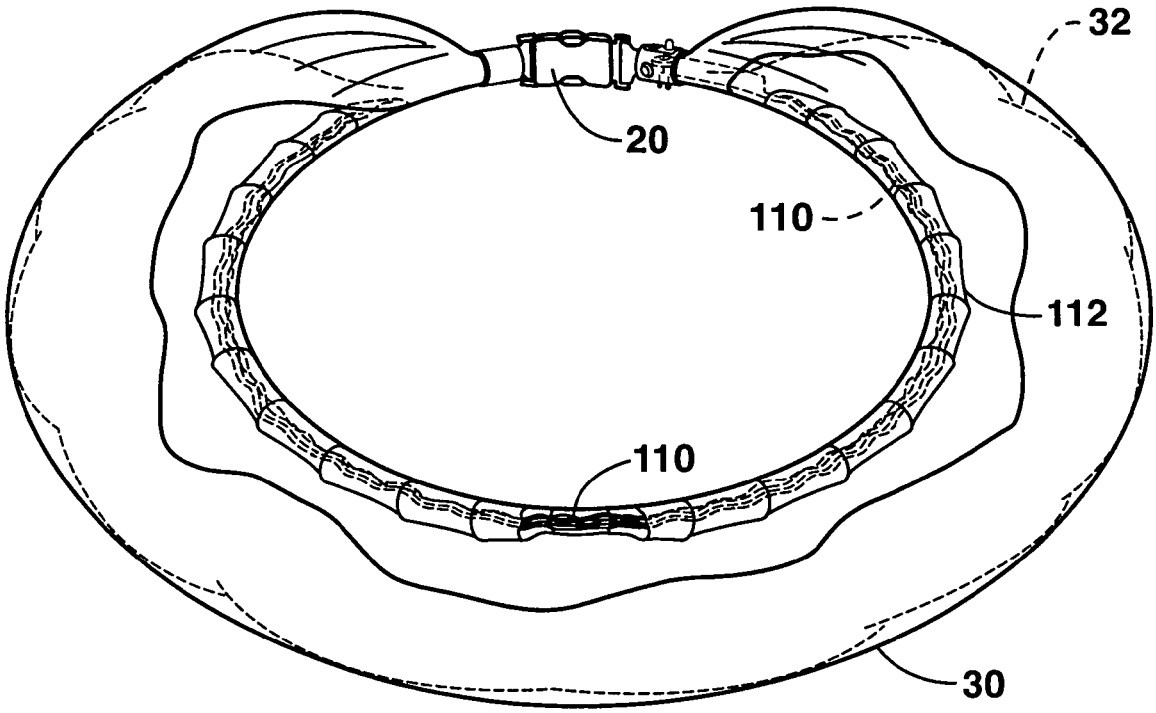
FIG. 8 is an additional embodiment of an inflatable necklace setting forth internal features of its construction.

An additional embodiment of the inflatable necklace is seen in reference to FIG. 8. In the embodiment of FIG. 8, following activation of the sensor 60, an electrical charge is used to ignite a length of gun cotton 110 which is sealed in a foil wrapper 112 and positioned within an interior of the bladder 32. The gun cotton will rapidly ignite and the resulting combustion products will inflate the respective inner bladder 32 and/or outer bladder 30. The foil wrapper 112 surrounding the gun cotton 110 helps dissipate heat associated with the combustion of the gun cotton 110.

The inflatable necklace is designed for use with young children. As such, the size and volume of the respective air bladders are not as great as other self-inflating life preserver products which are designed for use with adults. Accordingly, the volume of pressurized gas that needs to be supplied to chamber is relatively small and which permits the use of compact pressurized canisters and/or smaller volumes or packages of gas producing reactants.

For embodiments which use an inner bladder 32 to provide the necessary inflation and floatation properties, the material comprising outer bladder 30 may be provided by a variety of flexible materials and may include various fabrics which are not necessarily airtight. Accordingly, the fabric for bladder 30 may be similar to or different from the materials used to provide an inflatable bladder 32 though the two materials should be compatible for the purposes of sonic welding or otherwise fastening the materials together in a sealed manner.

If desired, the outer bladder 30 may be of a very porous material through which water may easily enter and drain. In addition, there may be benefits to placing periodic eyelets within the outer bladder 30 of necklace 10 so as to allow the easy entry and drainage of water.

It is also envisioned that necklace 10 may incorporate an alarm indicator 90 (FIGS. 7B and 7C) which signals an audible alert when the sensor 60 is activated. The alarm enables adults or other responsible individuals in the vicinity to offer immediate assistance to a child. A test button 95 (FIGS. 7B and 7C) may also be provided which will activate the light 92 and the alarm 90 to indicate the bladder and circuitry is operative.

Further, the outer bladder 30 may be provided with distinctive, high visibility color or markings to assist in locating an individual in distress. It is also envisioned that upon activation and inflation, a series of lights 92 such as diodes may flash along with an audible alarm to assist in locating a child in darkness or low visibility conditions such as fog.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

The invention claimed is:

1. An inflatable necklace comprising:

a cylindrically shaped fabric shell having a reclosable fastener thereon for attaching opposing ends of said necklace around an individual's neck, a portion of said fabric shell defining a housing;

a sensor positioned within said housing, said sensor having a pair of sensor contacts set a apart a spaced distance thereby preventing sensor activation unless the sensor is submerged in water, said sensor further having a time delay interval requiring sensor contacts to be continuously immersed in water for about 5 seconds before activation of said sensor;

a gas source capable of releasing a desired volume and rate of gas in response to a signal from said sensor;

at least one expandable bladder, said bladder adapted for receiving said released gas and thereby inflating said bladder;

wherein, when said bladder is inflated, the necklace provides sufficient buoyancy to support a child within a body of water.

2. An inflatable necklace according to claim 1 wherein said at least one expandable bladder further comprises a high visibility material.

3. An inflatable necklace according to claim 1 wherein said necklace further comprises a light source which illuminates when said sensor is activated.

4. An inflatable necklace according to claim 1 wherein said gas source comprises a container filled with a pressurized gas.

5. The inflatable necklace according to claim 1 wherein said gas source comprises a first reactant and a second reactant which upon combination generates said desired volume and rate of gas.

6. An inflatable necklace comprising:

a cylindrically shaped fabric shell having a reclosable fastener thereon for attaching opposing ends of said necklace around an individual's neck;

a sensor supported by said reclosable fastener, said sensor being activated upon exposure to one of a predetermined time interval, submersion under water or a sudden increase in pressure;

a gas source capable of releasing a desired volume and rate of gas in response to a signal from said activated sensor, said gas source comprising a sealed tube of a compressed gas having a microvalve which is activated by a signal from said sensor, thereby releasing the pressurized fluid contents;

at least one expandable bladder positioned within said fabric shell, said bladder adapted for receiving said released gas and thereby inflating said bladder;

wherein, when said bladder is inflated, the necklace provides sufficient buoyancy to support a child within a body of water.

7. An inflatable necklace according to claim 6 wherein said gas source is defined by a sealed tube of a compressed fluid.

8. An inflatable necklace comprising:

a cylindrically shaped fabric shell having a reclosable fastener thereon for attaching opposing ends of said necklace around an individual's neck;

a sensor supported by said reclosable fastener, said sensor being activated upon exposure to one of a predetermined time interval, submersion under water or a sudden increase in pressure;

a gas source capable of releasing a desired volume and rate of gas in response to a signal from said activated sensor, said gas source further defining a sealed tube of a compressed gas having a sealed portion which includes a wire, said wire being heated in response to a signal from said sensor, thereby unsealing the tube and releasing a gas;

at least one expandable bladder positioned within said fabric shell, said bladder adapted for receiving said released gas and thereby inflating said bladder;

wherein, when said bladder is inflated, the necklace provides sufficient buoyancy to support a child within a body of water.

9. An inflatable necklace comprising:

a cylindrically shaped fabric shell having a reclosable fastener thereon for attaching opposing ends of said necklace around an individual's neck;

a sensor supported by said reclosable fastener, said sensor being activated upon exposure to one of a predetermined time interval, submersion under water or a sudden increase in pressure;

a gas source in the form of gun cotton capable of releasing a desired volume and rate of gas in response to a signal from said activated sensor;

at least one expandable bladder positioned within said fabric shell, said bladder adapted for receiving said released gas and thereby inflating said bladder;

wherein, when said bladder is inflated, the necklace provides sufficient buoyancy to support a child within a body of water.

* * * * *